United States Patent [19]

Abe et al.

[11] 4,078,979

[45] Mar. 14, 1978

[54] NICKEL ELECTROWINNING PROCESS

[75] Inventors: Shinichiro Abe, Toronto; Aubrey S. Gendron, Walden; Victor A. Ettel, Mississauga, all of Canada

[73] Assignee: The International Nickel Company, Inc., New York, N.Y.

[21] Appl. No.: 762,737

[22] Filed: Jan. 26, 1977

[30] Foreign Application Priority Data

Sep. 2, 1976 Canada ..... 245281

[51] Int. Cl.[2] ..... C25C 1/08; C25D 3/12

[52] U.S. Cl. ..... 204/112; 204/49; 204/DIG. 2

[58] Field of Search ..... 204/112, 113, 49, DIG. 2

[56] References Cited

U.S. PATENT DOCUMENTS

| | | | |
|---|---|---|---|
| 1,352,328 | 9/1920 | Todd et al. | 204/49 |
| 2,061,592 | 11/1936 | Rapids | 204/15 |
| 2,208,657 | 7/1940 | Ballay | 204/49 |
| 2,615,837 | 10/1952 | Liger | 204/49 |
| 3,642,588 | 2/1972 | Charrier | 204/44 |

*Primary Examiner*—T. M. Tufariello

*Attorney, Agent, or Firm*—Francis J. Mulligan, Jr.; Ewan C. MacQueen

[57] ABSTRACT

Nickel is electrowon from aqueous, all-sulfate electrolytes containing small, controlled amounts of sulfur-free hydrocolloidal polymers of intermediate molecular weight. Operable hydrocolloidal polymers include dextrin, gum arabic and water-soluble cellulose derivatives.

5 Claims, No Drawings

NICKEL ELECTROWINNING PROCESS

The present invention is concerned with electrowinning of nickel and, more particularly with electrowinning of nickel from essentially all-sulfate solutions.

PROBLEM

It is common in hydrometallurgical processes applied to sulfidic nickel ores or to oxidic nickel ores which are treated to form nickel sulfide to arrive at purified nickel-containing, aqueous solutions (liquors) which are essentially all sulfate in nature. For various reasons, not the least of which is enhanced corrosion problems, workers in the art of hydrometallurgical recovery of nickel tend to avoid including chloride ion in nickel hydrometallurgical recovery systems even though chloride ion in a nickel sulfate electrolyte tends to enhance levelling in a nickel deposit. A problem exists in efficiently electrowinning essentially pure, sulfur-free nickel from such all-sulfate hydrometallurgical liquors. For efficient recovery to be attained by electrolysis, it is usually necessary that the cathodic deposit be built up to thicknesses of at least about 0.5 centimeters (cm); that cathode current densities of about 200 up to 600 amperes per square meter ($A/m^2$), or higher be used; that the deposits; whether in massive sheet form or as buttons or other small shapes; be adherent to cathode mandrels (e.g., titanium sheet cathodes) during electrodeposition and be readily strippable when fully formed; and that the deposits be pure and essentially free from sulfur, e.g., contain less than about 20 parts per million (ppm) by weight of sulfur. As far as applicants are aware, the prior art has not provided an electrowinning process which can satisfactorily accomplish all these requirements on an industrial scale.

PRIOR ART SUGGESTIONS

Numerous disclosures exist in the prior art which relate to electroplating of nickel and which may be deemed to be superficially similar to the teachings of the present invention. Basically, however, the bulk of the prior art teachings such as exemplified by U.K. Pat. No. 506,332 and U.S. Pat. Nos. 2,615,837; 3,642,588; 2,061,592 and 2,208,657 are concerned with mixed sulfate-chloride electrolytes and produce deposits which are at most about 0.05 cm thick. Some of these prior art electrolytes contain polymeric additives in amounts which radically increase the viscosity of the electrolyte and thus make the electrolyte unsuitable for use in electrowinning systems. Amounts of polymeric additive in excess of about 300 mg/l in either a sulfate-chloride electrolyte or in an all-sulfate electrolyte (as disclosed in U.S. Pat. No. 1,352,328) tend to degrade the appearance of a nickel deposit as the nickel deposit grows thicker than a normal thickness of an electroplate (e.g., maximum about 0.03 cm.). Furthermore, excess polymeric additive results in brittleness and high stress in thick deposits which can readily exfoliate from the cathode mandrel while deposition is continuing. Thus, the prior art has failed to provide a means whereby thick, well-levelled nickel deposits can be produced under electrowinning conditions which deposits adhere to a cathode mandrel during electrodeposition but which can be readily stripped when the electrowinning is completed.

DISCOVERY OF OBJECTS

It has now been discovered that by carefully controlling the electrowinning bath composition along with the electrowinning conditions commercially satisfactory electrowon, well-levelled, sulfur-free nickel deposits can be produced.

It is an object of the present invention to provide a novel process for electrowinning nickel from all-sulfate electrolytes.

Other objects and advantages will become apparent from the following description.

GENERAL DESCRIPTION OF THE INVENTION

Generally speaking, the present invention contemplates electrowinning nickel from an essentially chloride-free aqueous electrolyte containing about 40 to about 130 grams per liter (gpl) of nickel in the form of a water-soluble sulfate, about 0.5 to about 25 gpl of magnesium sulfate (measured as the anhydrous salt) about 75 to about 150 gpl of sodium sulfate (measured as the anhydrous salt) up to about 50 gpl of boric acid, about 30 to about 80 mg/l of a levelling agent selected from the group of dextrin, water soluble cellulose derivatives and low viscosity-type gums (all for purposes of this specification and claims designated as sulfur-free hydrocolloidal polymers of intermediate molecular weight) and from a small effective amount up to about 100 mg/l of a compatible wetting and anti-misting agent at a temperature of about 30° C to about 90° C and a cathode current density of about 200 to about $600A/m^2$, or higher for a time in excess of about 40 hours sufficient to build up upon the cathode a well-levelled, sulfur-free nickel deposit at least about 0.2 cm. thick. Usually much longer times, e.g., in excess of 190 hours are used to deposit thicknesses in excess of about 0.45 cm.

DEFINITIONS

For purposes of this specification and claims a "sulfur-free hydrocolloidal polymer of intermediate molecular weight" means a hydrophyllic polymer devoid of sulfur usually made up principally of hexose or pentose units and having a molecular weight such that when the polymer is dissolved in an aqueous nickel electrolyte in amounts of less than about 100 mg/l, the polymer will be dispersed in the aqueous phase without any significant gel formation or increase in electrolyte viscosity.

The term "dextrin" means an intermediate product formed by the hydrolysis of starches. Industrially it is made by treatment of various starches with dilute acids or by heating dry starch. The yellow or white powder or granules are soluble in water; insoluble in alcohol and ether. It is colloidal in properties and describes a class of substances, hence has no definite formula.

The term "water soluble cellulose derivatives" means chemically modified cellulose such as sodium carboxymethyl cellulose or methyl cellulose characterized such that when dissolved in an aqueous nickel electrolyte in amounts of less than about 100 mg/l, the cellulose derivative will be dispersed in the aqueous phase without any significant gel formation or increase in electrolyte viscosity.

The term "low viscosity type gums" a class of materials exemplified by gum arabic (also know as gum acacia) means any one or more of complex polysaccharides containing calcium, magnesium and/or potassium salts and which when dissolved in an aqueous nickel electrolyte in amounts of less than about 100 mg/l will be dispersed in the aqueous phase without any significant gel formation or increase in electrolyte viscosity.

PARTICULAR DESCRIPTION OF INVENTION

The electrowinning process of the present invention is usually carried out at a temperature of about 55° C to about 65° C in an electrowinning cell having an electrolyte inlet at one end, a plurality of cathode mandrels and permanent anodes interposed in the cell, a means for agitating the electrolyte in the cell and an electrolyte outlet at the other end of the cell. Usually, the incoming electrolyte has a pH of about 3 to 6 (as mentioned at room temperature) and the difference in concentration of nickel between the incoming electrolyte and the exiting electrolyte (i.e., the bite) is about 20 to about 25 grams per liter. Advantageously, the means for agitating the electrolyte can be air sparging. The cathodes can be bagged or in cases where lead-free anodes are used, bagging may be eliminated.

The electrolyte bath ingredients all cooperate to assist in providing well-levelled thick deposits. Specifically sodium sulfate, the wetting and anti-misting agent (advantageously sodium lauryl sulfate) and the sulfur-free hydrocolloidal polymer together coact to provide the required results. Too little of the sulfur-free hydrocolloidal polymer results in poorly levelled deposits. In particular, the production of electrolytic nickel rounds on masked cathode mandrels under such conditions is not attractive because of the irregular edge-bead formed on the deposit leads to short circuiting and unacceptable deposits (from a physical appearance view point). Addition of insufficient wetting agent, sodium lauryl sulfate, to all-sulfate electrolytes results in a deterioration of the physical appearance of the nickel deposit and in an increased incidence of pitting. Addition of insufficient $Na_2SO_4$ to the all-sulfate electrolyte also results in more poorly levelled deposits.

Addition of excess sulfur-free hydrocolloidal polymer to the all-sulfate electrolyte results in highly stressed, brittle nickel deposits which can readily exfoliate from the cathode substrate. Addition of excess $Na_2SO_4$ results in a streaked, pitted deposit, presumably caused by the higher electrolyte viscosity.

While the amount of sulfur-free hydrocolloidal polymer used in the electrolyte employed in the nickel electrowinning process of the present invention has been described generally as about 40 to about 80 mg/l, those skilled in the art will appreciate that each specific material will be most effective when used in special amounts. For example, when employing an electrolyte containing about 100 gpl of sodium sulfate, carboxymethyl cellulose of a grade exhibiting a 2% viscosity in water of about 50–100 centipoises (cps) is most advantageously used in amounts of about 30 to about 50 mg/l. Likewise, yellow potato dextrin of a grade identified as Number 4365 and sold in commerce by Stein, Hall Co., Inc., can be advantageously used in amounts of about 40 to 80 mg/l.

EXAMPLES

In order to give those skilled in the art a greater appreciation of the advantages of the invention, the following examples are given:

EXAMPLE I

Electrolytic nickel rounds containing less than 5 ppm sulfur were electrowon in a 4.5 l Hybinette-type cell (bagged cathode) using sandblasted titanium cathode (10 × 15 cm). After sandblasting the titanium cathode blank was masked circular areas (2.5 cm diameter) for electrodeposition. A Pb 6% Sb anode and a polyester cloth diaphragm were used for the test. Nickel was then electrowon from all-sulfate nickel electrolyte containing 70 g/l Ni, 5 g/l $MgSO_4$, 10 g/l $H_3BO_3$ and 140 g/l $Na_2SO_4$ (feed pH 5 at room temperature) to which 60 mg/l yellow potato dextrin and 40 mg/l sodium lauryl sulfate were added. The test conditions were: actual cathode current density 300 A/m$^2$, temperature 60° C, catholyte pH 3 at 60° C, nickel bite 25 g/l, total length of test50 h and no air sparging.

The current efficiency was about 85% and the resulting nickel rounds having an average thickness about 0.17 cm were smooth, compact and bright and has a good edge-bead. All of the deposits were observed to adhere well to the sandblasted titanium cathode mandrel during plating and yet could be readily removed from the blank upon completion of electrowinning.

EXAMPLE III

Electrolytic nickel rounds containing 5 ppm sulfur were electrowon in a 1 liter Hybinette type cell (bagged cathode) using a sandblasted titanium cathode (8 × 11 cm). After sandblasting the titanium cathode blank was masked with a conventional epoxy dielectric to give six unmasked circular areas (2.5 cm diameter) for electrodeposition. A Pb 6% Sb anode and a polyester cloth diaphragm were used for the test. Nickel was then electrowon from all-sulfate nickel electrolyte containing 70 g/l Ni, 25 g/l $MgSO_4$, 10 g/l $H_3BO_3$ and 100 g/l $Na_2SO_4$ (feed pH 5 at room temperature) to which 40 mg/l sodium carboxy methyl cellulose and 40 mg/l sodium lauryl sulfate were added. The test conditions were: actual cathode current density 600A/m$^2$, temperature 60° C, catholyte pH 3 at 60° C, nickel bite 25 g/l, total length of test 72 h and no air sparging.

The current efficiency was 85% and the resulting nickel rounds having an average thickness of about 0.49 cm. were smooth, compact and bright and had a good edge-bead. All of the deposits compact and bright and had a good edge-bead. All of the deposits were observed to adhere well to the sandblasted titaniun cathode mandrel during plating and yet could be readily removed from the blank upon completion of electrowinning.

EXAMPLE IV

Electrolytic nickel rounds containing 5 ppm sulfur were electrowon in a Hybinette type cell (bagged cathode) using a sandblasted titanium cathode (10 × 15 cm). After sandblasting the titanium cathode blank was masked with a conventional epoxy dielectric to give eight unmasked circular areas (2.5 cm diameter) for electrodeposition. A Pb 6% Sb anode and a polyester cloth diaphragm were used for the test. Nickel was then electrowon from all-sulfate nickel electrolyte containing 70 g/l Ni, 25 g/l $MgSO_4$, 10 g/l $H_3BO_4$ and 140 g/l $Na_2SO_4$ (feed pH 5 at room temperature) to which 40 mg/l gum Acacia and 40 mg/l sodium lauryl sulfate plus 5 mg/l Polymer F-3 a non-ionic type polymer sold by Stein, Hall Co., Inc., were added. The test conditions were: actual current density 400 A/m$^2$, temperature 60° C, catholyte pH 3 at 60° C, nickel bite 25 g/l, total length of test 72 h and moderate air sparging (24 l/h) over the face of the cathode was employed.

The current efficiency was 85% and the resulting nickel rounds having an average thickness of about 0.33 cm. were smooth, compact and bright and had a fairly good edge-bead. All of the deposits were observed to adhere well to the sandblasted titanium cathode mandrel during plating and yet could be readily removed from the blank upon completion of electrowinning.

Those skilled in the art will appreciate that while all the foregoing examples show the production of nickel rounds about 2.5 cm. in diameter, the invention is equally applicable to the production of other sizes and shapes of nickel including, of course, the production of full size cathode nickel deposits of area of about 1 square meter.

Although the present invention has been described in conjunction with the preferred embodiments it is to be recognized that modifications and variations may be resorted to without departing from the spirit and scope of the present invention as those skilled in the art will readily understand. Such modifications and variations are considered to be within the purview and scope of the invention and appended claims.

We claim:

1. A process for electrowinning nickel from an essentially chloride-free aqueous electrolyte containing about 40 to about 130 gpl of nickel in the form of a water-soluble sulfate, about 0.5 to about 25 gpl of magnesium sulfate, about 75 to about 150 gpl of sodium sulfate up to about 50 gpl of boric acid, about 30 to about 80 mg/l of a levelling agent consisting of a sulfur-free hydrocolloidal polymer of intermediate molecular weight and a small anti-misting agent at a temperature of about 30° C to about 90° C and a cathode current density of about 200 to about 600 $A/m^2$ or higher for a time in excess of about 40 hours sufficient to build up upon the cathode a well-levelled, sulfur-free nickel deposit at least about 0.2 cm. thick.

2. A process as in claim 1 wherein the sulfur-free hydrocolloidal polymer of intermediate molecular weight is selected from the group consisting of dextrin, gum arabic and water-soluble cellulose derivatives.

3. A process as in claim 1 wherein the sulfur-free hydrocolloidal polymer is dextrin and is employed in amounts of about 40 to about 80 mg/l.

4. A process as in claim 1 wherein the sulfur-free hydrocolloidal polymer is the sodium salt of carboxymethyl cellulose and is employed in amounts of about 30 to about 50 mg/l.

5. A process as in claim 2 carried out at a temperature of about 55° C to about 65° C.

* * * * *